US005309809A

United States Patent [19]

Sambuchi

[11] Patent Number: 5,309,809

[45] Date of Patent: May 10, 1994

[54] WINDCHIME APPARATUS

[76] Inventor: Kenneth E. Sambuchi, 428 Ballwin Ave., Winchester, Mo. 63021

[21] Appl. No.: 75,406

[22] Filed: Jun. 14, 1993

[51] Int. Cl.[5] ..... G10D 13/08

[52] U.S. Cl. ..... 84/404; D17/22; D17/99; D10/116; D11/141; 116/169

[58] Field of Search ..... 84/402, 403, 404, 406; 116/141, 169; 446/418; D17/22, 99; D10/116; D11/141

[56] References Cited

U.S. PATENT DOCUMENTS

D. 279,873 7/1985 Neely ..... 84/402

4,854,214 8/1989 Lowe ..... 84/404

4,967,633 11/1990 Jewell, Jr. ..... 84/404

*Primary Examiner*—Michael L. Gellner

*Assistant Examiner*—Cassandra C. Spyrou

*Attorney, Agent, or Firm*—Leon Gilden

[57] ABSTRACT

A central support tube includes an annular array of tonal tubes positioned thereabout, with each of the tubes suspended by an associated support line, that in turn is secured to a plurality of support pins directed into the central support tube. A cylindrical tuning disc is suspended below the central support tube for communication by the tonal tubes.

5 Claims, 4 Drawing Sheets

WINDCHIME APPARATUS

BACKGROUND OF THE INVENTION

1. Field of the Invention

The field of invention relates to windchime apparatus, and more particularly pertains to a new and improved windchime apparatus permitting modification of tonal response of the apparatus relative to gyration of the various components.

2. Description of the Prior Art

Windchime structure of various types have been utilized throughout the prior art and exemplified by the U.S. Pat. Nos. 4,854,214; 4,967,633; and U.S. Pat. No. 317,419.

The instant invention attempts to overcome deficiencies of the prior art by providing for a windchime apparatus arranged for ease of adjustment of tonal response of the windchime structure and in this respect, the present invention substantially fulfills this need.

SUMMARY OF THE INVENTION

In view of the foregoing disadvantages inherent in the known types of windchime apparatus now present in the prior art, the present invention provides a windchime apparatus including tubes arranged for adjustment of tonal response. As such, the general purpose of the present invention, which will be described subsequently in greater detail, is to provide a new and improved windchime apparatus which has all the advantages of the prior art windchime apparatus and none of the disadvantages.

To attain this, the present invention provides a central support tube including an annular array of tonal tubes positioned thereabout, with each of the tubes suspended by an associated support line, that in turn is secured to a plurality of support pins directed into the central support tube. A cylindrical tuning disc is suspended below the central support tube for communication by the tonal tubes.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved windchime apparatus which has all the advantages of the prior art windchime apparatus and none of the disadvantages.

It is another object of the present invention to provide a new and improved windchime apparatus which may be easily and efficiently manufactured and marketed.

It is a further object of the present invention to provide a new and improved windchime apparatus which is of a durable and reliable construction.

An even further object of the present invention is to provide a new and improved windchime apparatus which is susceptible of a low cost of manufacture with regard to both materials and labor, and which accordingly is then susceptible of low prices of sale to the consuming public, thereby making such windchime apparatus economically available to the buying public.

Still yet another object of the present invention is to provide a new and improved windchime apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
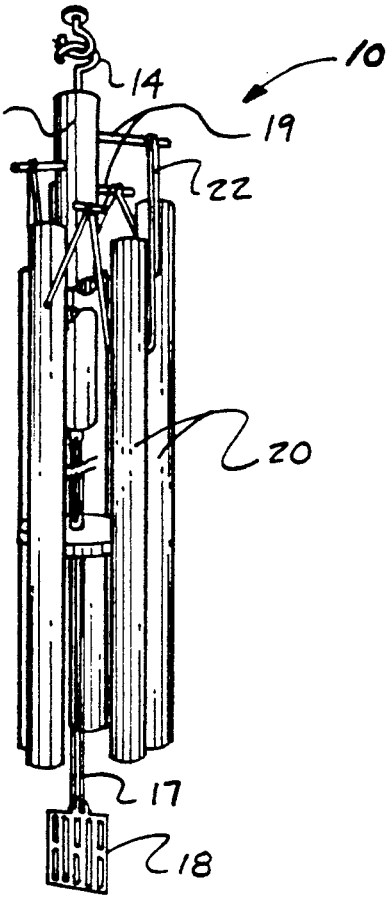
FIG. 1 is an isometric illustration of the invention.
Figure 2:
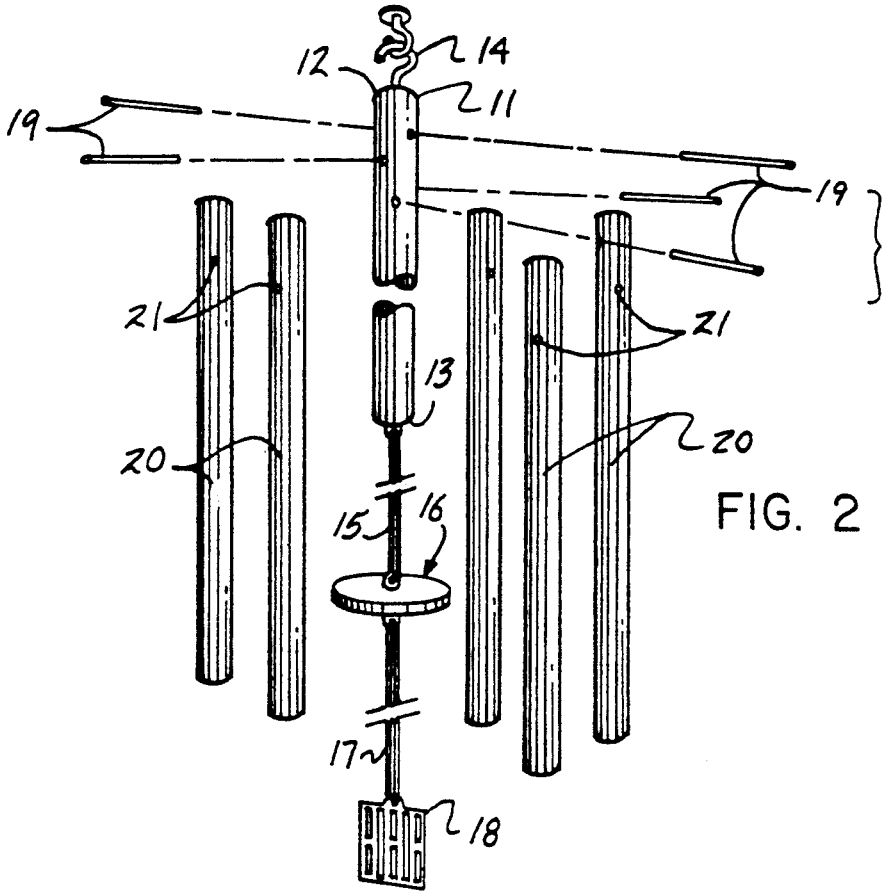
FIG. 2 is an exploded isometric view of the invention.
Figure 3:
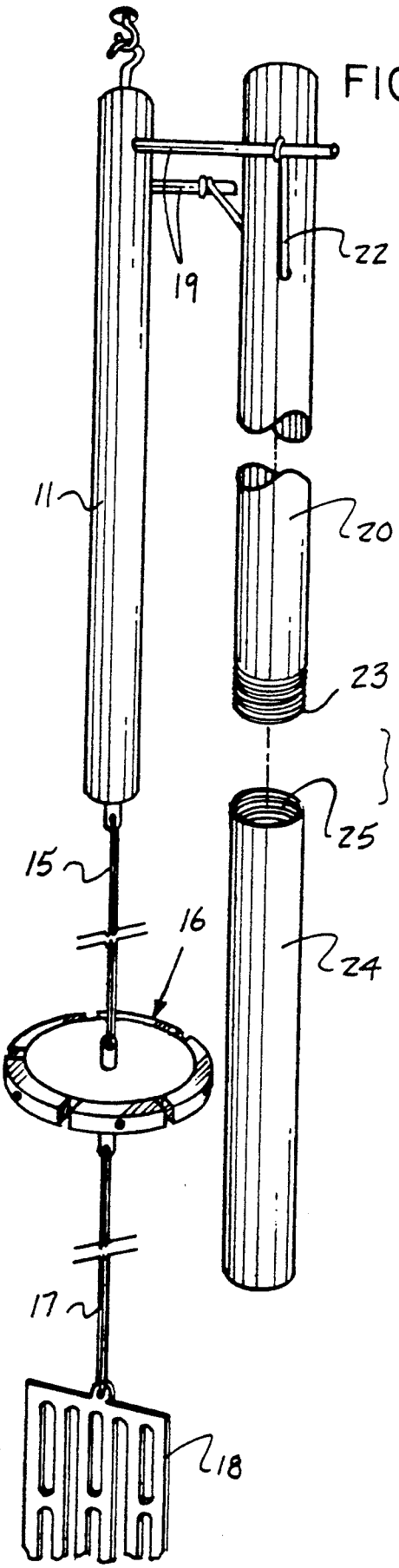
FIG. 3 is an isometric illustration of an adjustable tonal tube structure.
Figure 4:
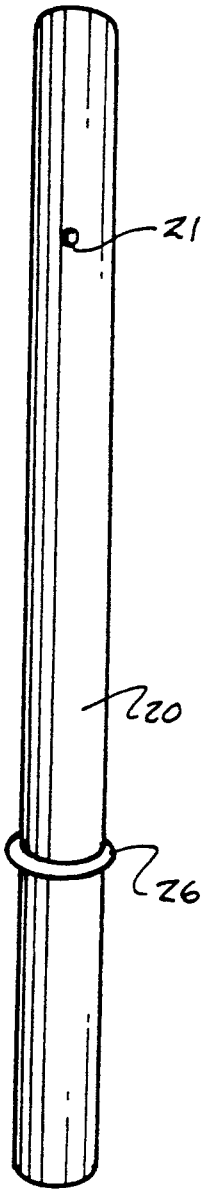
FIG. 4 is an isometric illustration of a tonal tube employing an "O" ring member arranged to dampen tonal response thereof.

With reference now to the drawings, and in particular to FIGS. 1 to 7 thereof, a new and improved windchime apparatus embodying the principles and concepts of the present invention and generally designated by the reference numeral 10 will be described.

More specifically, the windchime apparatus 10 of the instant invention essentially comprises an elongate central support tube 11, having a first end 12 spaced from a second end 13 coaxially aligned relative to one another, with a support hook 14 mounted to the first end 13 for mounting the support tube with the second end, having a first tether line 15 extending therefrom. The first tether line 15 is secured to a top surface of a cylindrical tuning disc 16 coaxially thereof, with a second tether line 17 extending from the tuning disc coaxially aligned with the tuning disc and the first tether line 15, as well as the central support tube 11, terminating in a balance plate 18 mounted to the second tether line 17 spaced from the tuning disc 16. The balance plate 18 is arranged to maintain alignment of the tuning disc relative to the central tube 11, as illustrated.

A plurality of tonal tubes 20 are mounted in surrounding relationship about the central tube 11, with each of the tonal tubes having a tube through-extending bore 21 adjacent the tonal tube uppermost end, with a support line 22 directed through each of the tube through-extending bores 21 and mounted about support pins 19 that are directed into the central tube 11 in an annular array at various heights relative to one another to provide for desired spacing vertically of the tonal tubes relative to one another in adjacency to the central tube 11. As illustrated in the FIG. 3, the tonal tubes may be optionally provided with a lowermost threaded end 23 arranged for securement to a tonal tube extension tube 24 to provide for various lengths of the tonal tubes and modification of sound production thereby. Further, a resilient "O" ring 26 is arranged for securement about at least one said tonal tubes to provide for desired attenuation and dampening of tone generated within a respective tonal tube.

Figure 5:
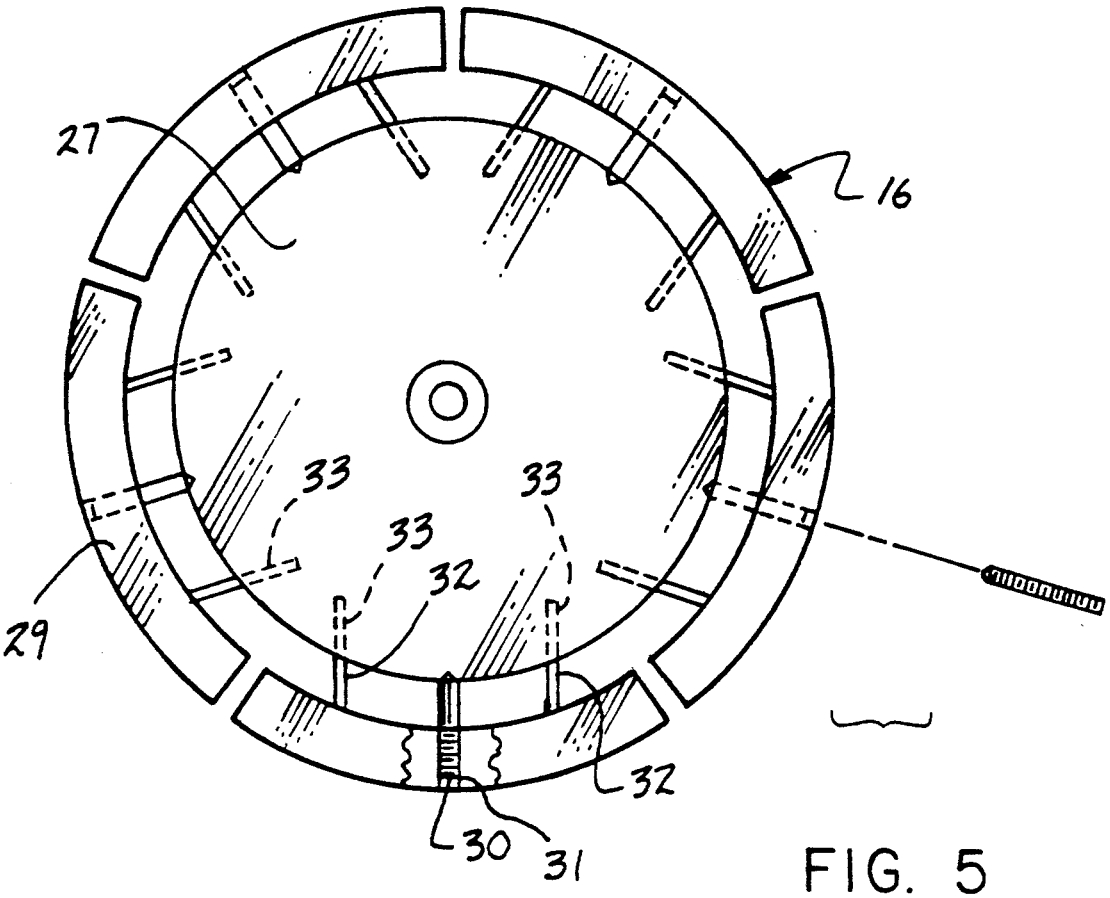
FIG. 5 is an orthographic top view of the tuning disc of the invention.
Figure 6:
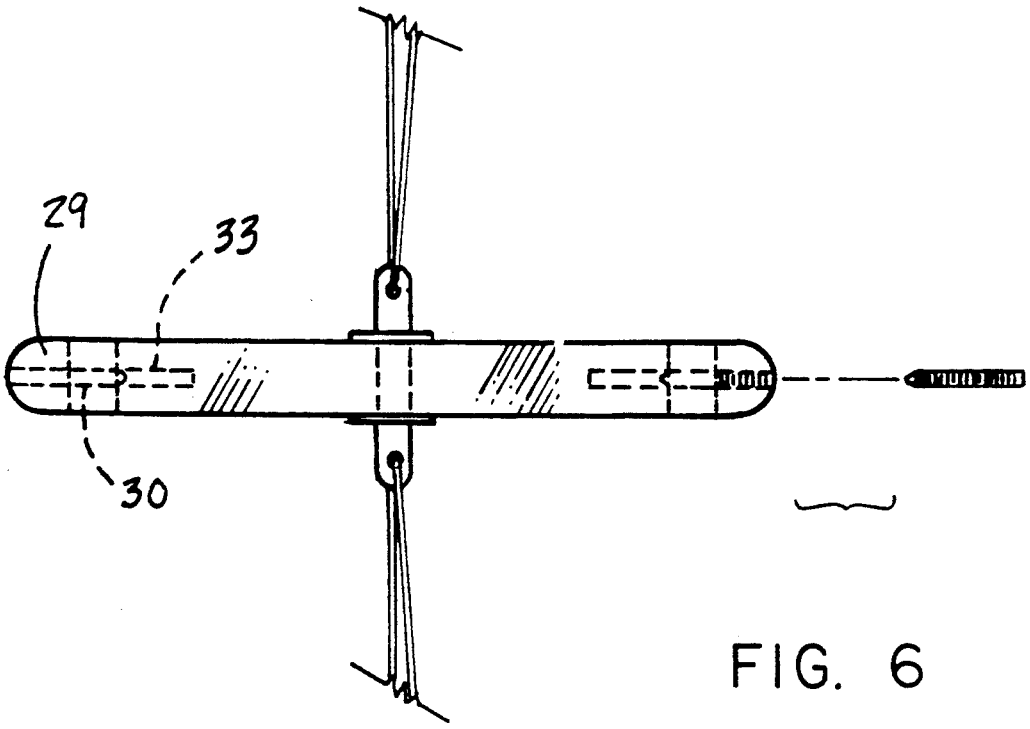
FIG. 6 is an orthographic side view of the tuning disc.
Figure 7:
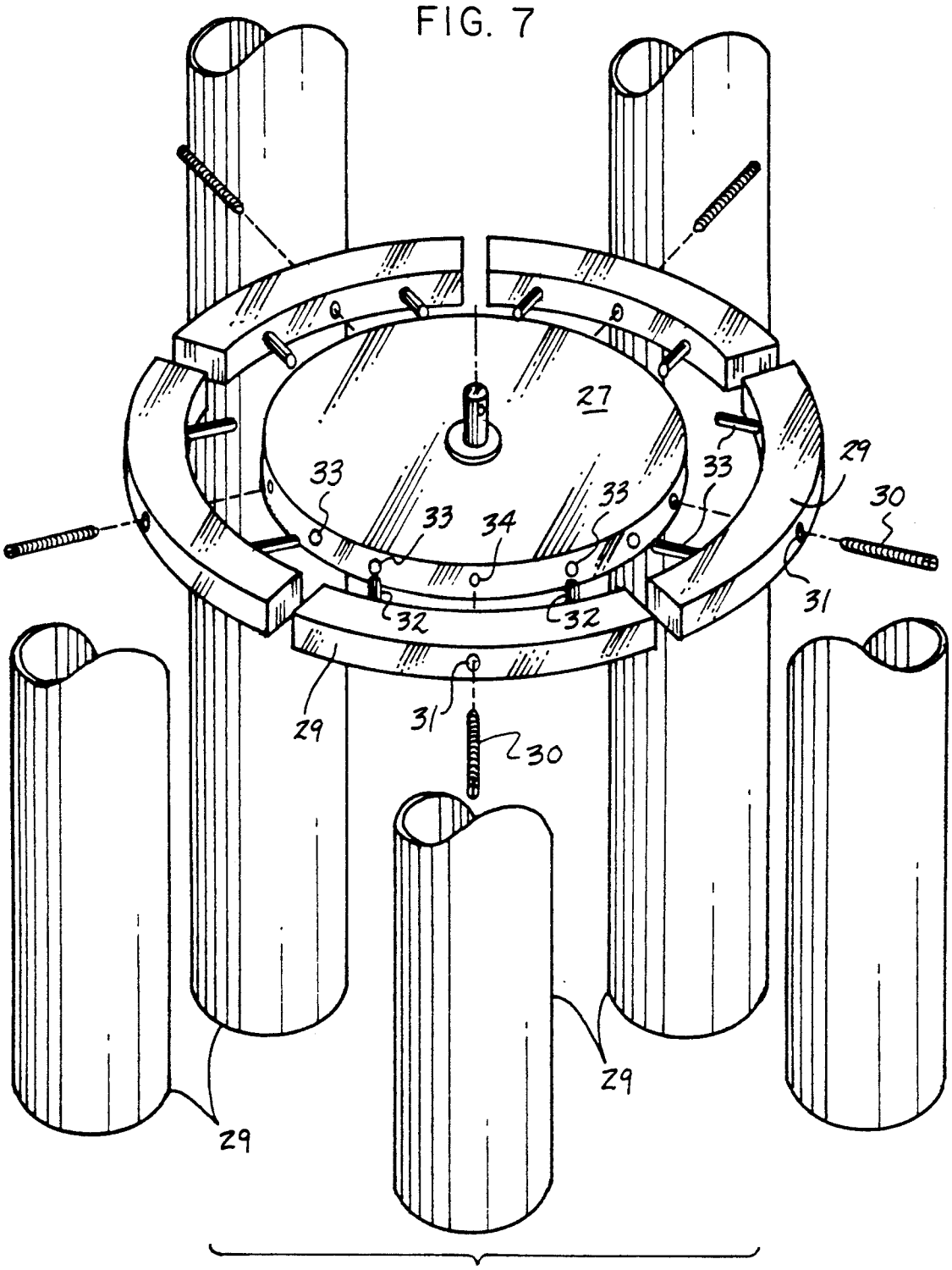
FIG. 7 is an isometric illustration of the tuning disc oriented intermediate the tonal tubes.

The FIGS. 5–7 indicate details of the tuning disc 16, having a central plate 27 that is formed with an annular periphery 28. Semi-annular segments 29 are mounted in spaced adjacency about the annular periphery 28, with each of the segments 29 having an externally threaded adjuster rod 30 threadedly directed through an internally threaded segment bore 31 radially aligned with the central plate 27 for engagement with an adjuster rod guide recess 34 directed into the annular periphery 28. A plurality of parallel guide pins 32 are directed through each of the segments 29 received slidably within an associated guide pin bore 33. In this manner, spacing of the segments 29 is available providing for various impact to an adjacent tonal tube. To this end, typically, the predetermined number of segments 29 are equal to a like predetermined number of tonal tubes 20.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A windchime apparatus, comprising, a central support tube, the central support tube having a first end spaced from a second end, with a support member mounted to the first end, and a first tether line extending from the second end, and a cylindrical tuning disc mounted to the first tether line spaced from the support member, and a second tether line secured to the tuning disc spaced from the first tether line, and a balance plate mounted to the second tether line spaced from the tuning disc, with the balance plate, the second tether line, the tuning disc, and the first tether line and the central support tube coaxially aligned relative to one another, and a plurality of tonal tubes mounted to and in a surrounding relationship about the central support tube in a spaced relationship arranged for communication with the tuning disc, wherein each of the tonal tubes includes a through-extending bore directed through each of said tonal tubes and a plurality of support lines with an individual support line of said plurality of support lines directed through one of said through-extending bores of an individual tonal tube of said plurality of tonal tubes, with a plurality of support pins fixedly mounted in an annular array to and about the central support tube, with each of said support lines secured to a pair of adjacent of said plurality of support pins.

2. An apparatus as set forth in claim 1 wherein the support pins are vertically displaced relative to one another about the central support tube.

3. An apparatus as set forth in claim 2 wherein one of said tonal tubes includes a lowermost threaded end, and at least one extension tube arranged for securement to the lowermost threaded end.

4. An apparatus as set forth in claim 3 including at least one resilient "O" ring mounted about one of said tonal tubes, wherein the resilient ring is arranged for tonal dampening of at least one of said tonal tubes.

5. An apparatus as set forth in claim 4 wherein the tuning disc includes a central annular plate having an annular periphery, the annular periphery having a plurality of semi-annular segments mounted about the annular periphery, each of the segments including an externally threaded adjuster rod threadedly directed medially of each of the segments radially aligned with the central plate, with the central plate having a guide recess directed into the annular periphery for receiving said adjuster rod, and each of the segments having a plurality of guide pins parallel relative to one another, and the central plate having a plurality of guide pin bores in adjacency to each of the segments for receiving the parallel guide pins of each of said segments.

* * * * *